United States Patent [19]

Burdick

[11] 4,251,747

[45] Feb. 17, 1981

[54] ONE PIECE ASTIGMATIC GRID FOR COLOR PICTURE TUBE ELECTRON GUN

[75] Inventor: Glen A. Burdick, Waterloo, N.Y.

[73] Assignee: GTE Products Corporation, Stamford, Conn.

[21] Appl. No.: 94,515

[22] Filed: Nov. 15, 1979

[51] Int. Cl.[3] ..... H01J 1/46; H01J 17/04; H01J 19/38; H01J 19/40

[52] U.S. Cl. ..... 313/348; 313/414; 313/447; 313/458; 29/25.14; 29/25.17

[58] Field of Search ..... 313/348, 349, 447, 452, 313/453, 454, 414, 416, 436, 458, 435, 437; 29/25.14, 25.17

[56] References Cited

U.S. PATENT DOCUMENTS

| | | | |
|---|---|---|---|
| 2,125,418 | 8/1938 | Benjamin et al. | 313/447 |
| 2,712,087 | 6/1955 | Fite et al. | 313/348 X |
| 2,937,314 | 5/1960 | Fyler | 313/453 X |
| 3,005,123 | 10/1961 | Griffiths | 313/348 X |
| 3,852,608 | 12/1974 | Johanns et al. | 313/458 |
| 3,919,583 | 11/1975 | Hasker et al. | 313/414 |
| 4,104,554 | 8/1978 | Kolbeck et al. | 313/458 |

*Primary Examiner*—Saxfield Chatmon, Jr.
*Attorney, Agent, or Firm*—William H. McNeill

[57] ABSTRACT

A one-piece control grid for functioning as an astigmatic lens in an electron gun has a milled, ground, or machined slot formed across its functional grid area. A suitable beam aperture is provided in the bottom of the slot.

8 Claims, 6 Drawing Figures

ONE PIECE ASTIGMATIC GRID FOR COLOR PICTURE TUBE ELECTRON GUN

TECHNICAL FIELD

This invention relates to electron guns for color television picture tubes and more particularly to astigmatic grids therefor and to a method of making such grids.

BACKGROUND OF THE INVENTION

The use of astigmatic electron lenses in electron guns is known. Generally, the lenses form a noncircular electron beam bundle, usually elliptical in cross-section. Exemplary lenses of this general description are shown in U.S. Pat. Nos. 3,852,608; 3,866,081; 3,873,878; 4,143,293; and in FIGS. 1 and 2 of the instant specification. These prior art lenses are complicated and expensive to make and require either a two part grid or cooperation between two or more grids.

DISCLOSURE OF THE INVENTION

It is therefore an object of this invention to provide an astigmatic lens employing a one piece grid that is economical to fabricate and one that obviates the disadvantages of the prior art.

It is another object of the invention to provide a method of making such a grid.

The objects are accomplished in one aspect of the invention by the provision of such a grid which has a functional grid area defined by a given perimeter and having a given thickness. A transverse slot is formed in the functional grid area and has a depth less than the given thickness of the grid area. The slot extends entirely across the functional grid area. An aperture is provided within the slot and penetrates the remaining part of the given thickness.

In a preferred method of making the grid the slot is milled thereacross and the aperture is punched.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
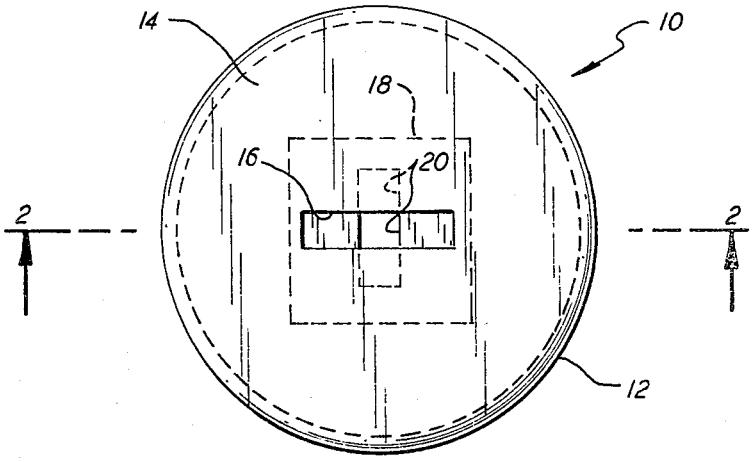
FIG. 1 Prior Art
FIG. 1 is a plan view of one form of prior art astigmatic lens.
Figure 2:
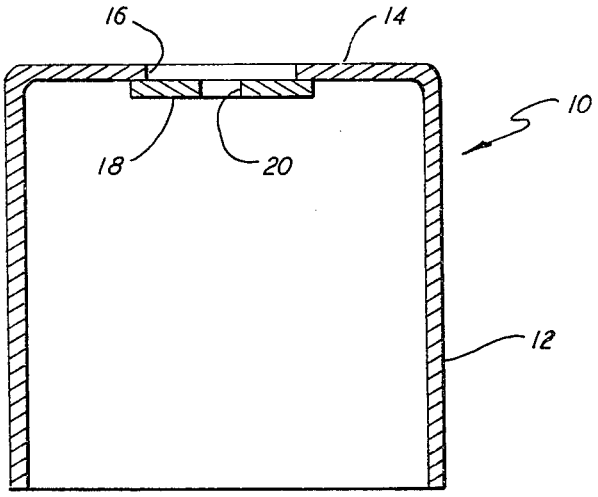
FIG. 2 Prior Art
FIG. 2 is a sectional view taken along the line 2—2 of FIG. 1.

Referring now to the drawings with greater particularity there is shown in FIG. 1 a plan view of a prior art astigmatic lens formed in the $G_1$ or control grid 10 of an electron gun. Grid 10 in this invention is a cup-shaped structure having a peripheral wall 12 and a functional grid area 14. This area 14 is provided with an elongated rectangular aperture 16. A second grid element 18 is provided with a similar elongated rectangular aperture

20, which latter aperture is positioned in orthogonal relation to aperture 16. Grid element 18 is welded to the underside of functional area 14 to maintain its position. When viewed in plan this construction shows a substantially square aperture leading into a rectangular slot. The shape of the aperture and slot function as an astigmatic lens in a finished electron gun, as is known in the art. The problems with this construction are its expense, the difficulty of keeping proper alignment between the two slots and the fact that the weld areas can cause raised portions which affect the $G_1$-$G_2$ spacing and degrade the desired focus characteristics.

Figure 3:
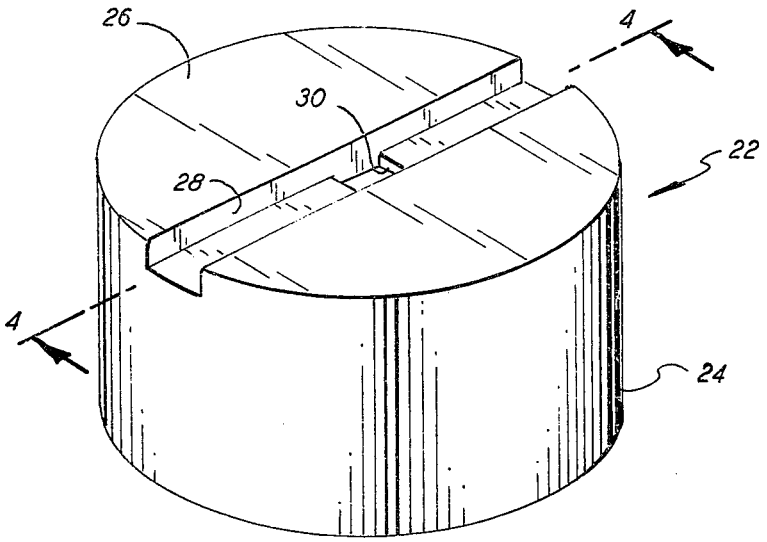
FIG. 3 is a perspective view of the grid of the invention.
Figure 4:
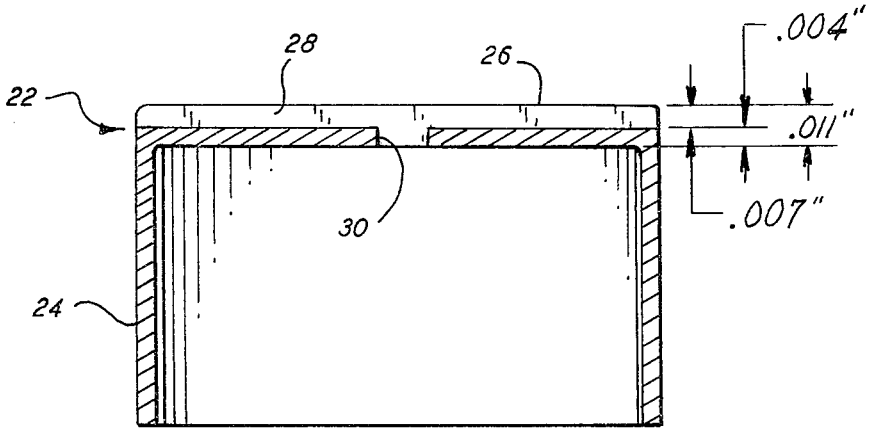
FIG. 4 is a sectional view taken along the line 4—4 of FIG. 3.
Figure 5:
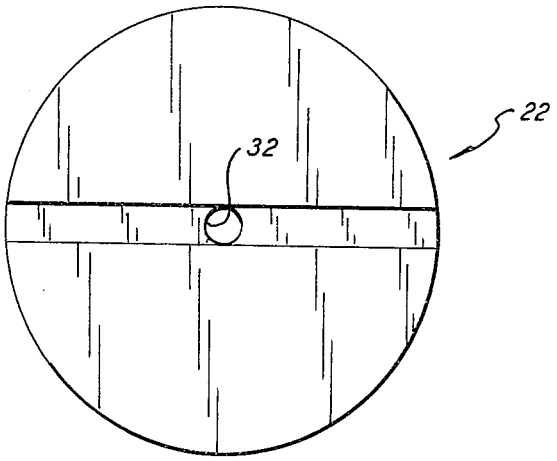
FIG. 5 is a plan view of an alternate embodiment of a grid.
Figure 6:
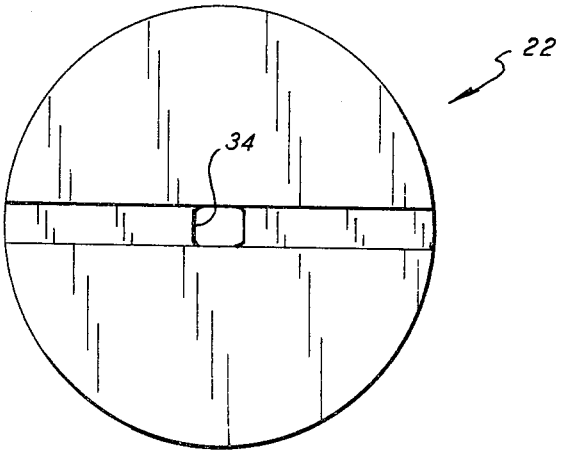
FIG. 6 is a plan view of a second alternate embodiment.

To obviate these problems there is provided the one-piece structure of FIG. 3. Therein is shown a grid 22 having a peripheral side wall 24 and a functional grid area 26 having a machined or milled slot 28 extending across the entire face of functional grid area 26. The depth of this slot 28 can be very accurately controlled, and some typical, non-limiting, dimensions are shown in FIG. 4. The depth of slot 28 is less than the total thickness of functional area 26. A beam aperture 30 is provided in the bottom of slot 28. A great variety of aperture configurations is available to meet desired beam characteristics with this construction. Thus, in the embodiment shown in FIGS. 3 and 4 the aperture 30 is substantially square. In FIG. 5 an aperture 32 is substantially circular; and in FIG. 6 an aperture 34 is quadrangular with rounded corners. The various apertures can be formed by any suitable techniques, such as drilling, punching, laser boring, etc., so long as the edges of the aperture remain substantially burr free.

This one-piece construction provides unique advantages over the complex prior art structures, particularly in its inexpensive construction and the control of the flatness of its operating surfaces.

While there have been shown what are at present considered to be the preferred forms of the invention, it will be apparent to those skilled in the art that various changes and modifications can be made herein without departing from the scope of the invention as defined by the appended claims.

I claim:

1. A one piece, astigmatic grid for a cathode ray tube electron gun comprising: a functional grid area defined by a given perimeter and having a given thickness; a transverse slot formed in said functional grid area having a depth less than that of said given thickness, said slot having a length which extends entirely across said functional grid area; and an aperture within said slot, said aperture penetrating the remaining part of said given thickness.

2. The grip of claim 1 wherein the walls defined by said slot are substantially parallel.

3. The grid of claim 2 wherein said aperture is noncircular.

4. The grid of claim 2 wherein said aperture is circular.

5. The grid of claim 2 wherein said aperture is substantially square with a radius formed at each of the internal corners.

6. In a method of making a one piece, astigmatic grid for a cathode ray tube electron gun, the steps comprising: forming a pre-grid with a functional grid area, said functional grid area having a given perimeter and a given thickness; forming a transverse slot in said functional grid, said slot extending entirely across said functional grid area and having a depth less than that of said given thickness; and forming an aperture within said slot, said aperture penetrating the remaining part of said thickness.

7. The method of claim 6 wherein said slot is formed by milling.

8. The method of claim 6 wherein said slot is formed by grinding.

* * * * *